US008011364B2

(12) United States Patent
Johnson

(10) Patent No.: US 8,011,364 B2
(45) Date of Patent: Sep. 6, 2011

(54) EXHALATION VALVE FOR USE IN AN UNDERWATER BREATHING DEVICE

(76) Inventor: Mark R. Johnson, Sandy, UT (US)

( * ) Notice: Subject to any disclaimer, the term of this patent is extended or adjusted under 35 U.S.C. 154(b) by 571 days.

(21) Appl. No.: 12/034,617

(22) Filed: Feb. 20, 2008

(65) Prior Publication Data

US 2008/0135045 A1 Jun. 12, 2008

Related U.S. Application Data

(63) Continuation-in-part of application No. 11/437,113, filed on May 18, 2006.

(60) Provisional application No. 60/890,795, filed on Feb. 20, 2007.

(51) Int. Cl.

| | |
|---|---|
| ***B63C 11/16*** | (2006.01) |
| ***B63C 11/02*** | (2006.01) |
| ***B63C 11/00*** | (2006.01) |
| ***B63C 11/10*** | (2006.01) |
| ***A62B 18/10*** | (2006.01) |
| ***F16K 15/00*** | (2006.01) |

(52) U.S. Cl. ..... 128/201.11; 218/201.11; 218/201.27; 218/201.28; 405/185; 405/186; 405/187; 137/512.4; 137/516.27

(58) Field of Classification Search ..... 128/201.11, 128/201.27, 201.28; 405/185, 186, 187; 137/512.4, 516.27

See application file for complete search history.

(56) References Cited

U.S. PATENT DOCUMENTS

| | | | |
|---|---|---|---|
| 2,859,771 | A | 11/1958 | Blagg |
| 3,473,561 | A | 10/1969 | Svenson et al. |
| 3,860,042 | A | 1/1975 | Green |
| 3,911,949 | A | 10/1975 | Hilden et al. |
| 3,949,780 | A | 4/1976 | Buckman |
| 3,993,060 | A | 11/1976 | Mitchell |
| 4,032,106 | A | 6/1977 | Schieser et al. |
| 4,066,077 | A | 1/1978 | Shamlian |
| 4,071,024 | A | 1/1978 | Blanc |

(Continued)

FOREIGN PATENT DOCUMENTS

| | | |
|---|---|---|
| GB | 1357249 | 6/1974 |

(Continued)

OTHER PUBLICATIONS

International Search Report and Written Opinion from PCT/US2007/082520, dated May 7, 2008, 10 pages.

(Continued)

*Primary Examiner* — Patricia M Bianco
*Assistant Examiner* — Nihir Patel
(74) *Attorney, Agent, or Firm* — Maschoff Gilmore & Israelsen

(57) ABSTRACT

An underwater breathing device, such as a snorkel, may include an exhalation valve. The exhalation valve is configured to produce positive end-expiratory pressure in the airway of a user of the underwater breathing device. The exhalation valve includes a plate defining an exhalation port and at least one chamber port, an exhalation conduit connected to the exhalation port, and a flexible membrane that is sealable against a surface of the plate. A lower portion of the exhalation conduit is divided by a septum which divides the exhalation conduit and the exhalation port into a first exhalation port connected to a first exhalation conduit and a second exhalation port connected to a second exhalation conduit. The flexible membrane is sized and positioned to be capable of sealing the first exhalation port and the second exhalation port.

19 Claims, 12 Drawing Sheets

U.S. PATENT DOCUMENTS

| | | | | |
|---|---|---|---|---|
| 4,137,935 | A | | 2/1979 | Snowdon |
| 4,143,853 | A | | 3/1979 | Abramson |
| 4,230,240 | A | | 10/1980 | Laauwe |
| 4,278,080 | A | | 7/1981 | Schuch |
| 4,344,427 | A | | 8/1982 | Marvin |
| 4,523,610 | A | | 6/1985 | Orrico |
| 4,562,836 | A | | 1/1986 | Perron |
| 4,610,246 | A | | 9/1986 | Delphia |
| 4,655,212 | A | | 4/1987 | Delphia |
| 4,708,135 | A | | 11/1987 | Arkema |
| 4,731,075 | A | | 3/1988 | Gallo Mezo et al. |
| 4,782,830 | A | | 11/1988 | Forman |
| 4,793,341 | A | | 12/1988 | Arasmith |
| 4,805,610 | A | | 2/1989 | Hunt |
| 4,832,013 | A | | 5/1989 | Hartdom |
| 4,834,084 | A | | 5/1989 | Walsh |
| 4,860,739 | A | | 8/1989 | Vandepol |
| 4,862,903 | A | | 9/1989 | Campbell |
| 4,872,453 | A | | 10/1989 | Christianson |
| 4,877,022 | A | | 10/1989 | Christianson |
| 4,878,491 | A | | 11/1989 | McGilvray, III |
| 4,879,995 | A | | 11/1989 | Christianson |
| 4,884,564 | A | | 12/1989 | Lamont |
| 4,896,664 | A | | 1/1990 | Harayama |
| 4,907,582 | A | | 3/1990 | Meyerrose |
| 4,938,259 | A | | 7/1990 | Schmidt |
| 4,946,133 | A | | 8/1990 | Johnson et al. |
| 5,020,191 | A | | 6/1991 | Uke |
| 5,101,818 | A | | 4/1992 | Chace |
| 5,117,817 | A | | 6/1992 | Lin |
| 5,129,426 | A | | 7/1992 | Boehmer |
| 5,143,059 | A | | 9/1992 | Delphia |
| 5,199,422 | A | | 4/1993 | Rasocha |
| 5,231,982 | A | | 8/1993 | Harrison et al. |
| 5,245,997 | A | | 9/1993 | Bartos |
| 5,261,396 | A | | 11/1993 | Faulconer et al. |
| 5,265,591 | A | | 11/1993 | Ferguson |
| 5,267,556 | A | | 12/1993 | Feng |
| 5,271,432 | A | | 12/1993 | Gueret |
| 5,280,785 | A | | 1/1994 | Fujima |
| 5,297,545 | A | | 3/1994 | Infante |
| 5,327,849 | A | | 7/1994 | Miller |
| 5,357,654 | A | | 10/1994 | Hsing-Chi |
| 5,381,563 | A | | 1/1995 | Isabelle et al. |
| 5,398,673 | A | | 3/1995 | Lambert |
| 5,404,872 | A | | 4/1995 | Choi |
| 5,487,379 | A | | 1/1996 | Koshiishi |
| 5,518,026 | A | | 5/1996 | Benjey |
| 5,529,057 | A | | 6/1996 | Ferrero |
| 5,606,967 | A | | 3/1997 | Wang |
| 5,622,165 | A | | 4/1997 | Huang |
| 5,638,811 | A | | 6/1997 | David |
| 5,657,746 | A | | 8/1997 | Christianson |
| 5,664,558 | A | | 9/1997 | Wagner |
| 5,671,728 | A | | 9/1997 | Winefordner |
| 5,697,362 | A | | 12/1997 | Albrecht |
| 5,791,524 | A | | 8/1998 | Demarest |
| 5,865,169 | A | | 2/1999 | Lan |
| 5,868,129 | A | * | 2/1999 | Christianson ..... 128/201.11 |
| D406,333 | S | | 3/1999 | Garraffa |
| 5,893,362 | A | | 4/1999 | Evans |
| 5,906,199 | A | | 5/1999 | Budzinski |
| 5,924,416 | A | | 7/1999 | Miller |
| 5,937,850 | A | | 8/1999 | Kawashima |
| 5,947,116 | A | | 9/1999 | Gamow |
| 5,960,791 | A | | 10/1999 | Winefordner |
| 6,059,157 | A | | 5/2000 | Parsons et al. |
| 6,073,626 | A | | 6/2000 | Riffe |
| 6,079,410 | A | | 6/2000 | Winefordner et al. |
| 6,085,744 | A | | 7/2000 | Hermansen et al. |
| 6,119,685 | A | | 9/2000 | Kawashima |
| 6,123,320 | A | | 9/2000 | Rasanow et al. |
| 6,129,081 | A | | 10/2000 | Wu |
| 6,129,116 | A | | 10/2000 | Laskowski |
| 6,202,644 | B1 | | 3/2001 | Takeuchi |
| 6,240,962 | B1 | | 6/2001 | Tai et al. |
| 6,273,046 | B1 | | 8/2001 | Pierce |
| 6,276,362 | B1 | | 8/2001 | Chen-Lieh |
| 6,302,102 | B1 | | 10/2001 | Giroux |
| 6,318,363 | B1 | | 11/2001 | Monnich |
| 6,352,075 | B1 | | 3/2002 | Wang |
| 6,363,929 | B1 | | 4/2002 | Winefordner |
| 6,371,108 | B1 | | 4/2002 | Christianson |
| 6,394,417 | B1 | | 5/2002 | Browne |
| 6,401,711 | B1 | | 6/2002 | Tibbs |
| 6,435,178 | B1 | | 8/2002 | Lin |
| 6,478,024 | B1 | | 11/2002 | White |
| 6,513,520 | B2 | | 2/2003 | Vinokur et al. |
| 6,655,378 | B2 | | 12/2003 | Swetish |
| 6,709,604 | B2 | | 3/2004 | Tai et al. |
| 6,736,136 | B2 | | 5/2004 | Chen-Lieh |
| 6,827,105 | B1 | | 12/2004 | Marble et al. |
| 6,883,780 | B2 | | 4/2005 | Browne et al. |
| 6,908,210 | B2 | | 6/2005 | Kuo |
| 6,915,801 | B2 | | 7/2005 | Pokras |
| 7,182,093 | B2 | | 2/2007 | Call et al. |
| 7,185,796 | B2 | | 3/2007 | Parsons |
| 2002/0088460 | A1 | | 7/2002 | Monnich |
| 2002/0170558 | A1 | | 11/2002 | Vinokur |
| 2003/0029448 | A1 | | 2/2003 | Swetish |
| 2003/0037783 | A1 | | 2/2003 | Feng |
| 2004/0035414 | A1 | | 2/2004 | Johnson |
| 2005/0034726 | A1 | | 2/2005 | Pittaway et al. |
| 2006/0102176 | A1 | | 5/2006 | Junck |
| 2006/0272637 | A1 | | 12/2006 | Johnson |

FOREIGN PATENT DOCUMENTS

| | | |
|---|---|---|
| GB | 1434835 | 5/1976 |
| GB | 2171781 | 9/1986 |
| GB | 2313317 | 11/1997 |
| JP | 10-299922 | 11/1998 |
| JP | 2002-154480 | 5/2002 |
| JP | 2004-169748 | 6/2004 |
| TW | 573667 | 1/2004 |
| TW | M248730 | 11/2004 |
| TW | M252649 | 12/2004 |
| WO | WO 2006/042063 | 4/2006 |
| WO | WO 2006/127556 | 11/2006 |
| WO | WO 2006/127557 | 11/2006 |

OTHER PUBLICATIONS

Search Report from Taiwan Application No. 095118125, dated Feb. 18, 2008, 1 page.

Examination Report from Canadian Patent Application No. 2,609,204 dated Sep. 23, 2009, 2 pages.

Examination Report from New Zealand Patent Application No. 563367 dated Aug. 18, 2009, 2 pages.

Examination Report from New Zealand Patent Application No. 563368 dated Aug. 19, 2009, 2 pages.

European Search Report from EPO Patent Application No. 06770786.9 dated Aug. 5, 2009, 6 pages.

Office Action from U.S. Appl. No. 11/248,900 dated Oct. 16, 2009, 6 pages.

U.S. Appl. No. 10/453,462, filed Jun. 3, 2003, Johnson.

U.S. Appl. No. 11/244,522, filed Oct. 6, 2005, Johnson.

U.S. Appl. No. 11/248,900, filed Oct. 11, 2005, Johnson.

U.S. Appl. No. 11/923,423, filed Oct. 24, 2007, Johnson.

U.S. Appl. No. 11/437,113, filed May 18, 2006, Johnson.

Fee et al., "Cardiorespiratory responses to increased resistance during exercise," Lung Mechanics, 5032.

Ellingsen, "The influence on the breathing pattern in man of moderate levels of continuous positive and negative airway pressure and of positive end-expiratory pressure during air and $CO_2$ inhalation," ACTA Physiol Scand 1990, 138, 273-282.

Van Der Shans, "Effect of positive expiratory pressure on breathing pattern in healthy subjects," Eur Respir J, 1993, 6, 60-66.

Layon et al., "Continuous positive airway pressure and expiratory positive airway pressure increase functional residual capacity equivalently," CHEST, 89/4/Apr. 1986, p. 517.

Tobin et al., "Effect of positive end-expiratory pressure on breathing patterns of normal subjects and intubated patients with respiratory failure," Critical Care Medicine, 1983, p. 859, vol. 11—No. 11, Williams & Wilkins Co.

Savourey et al., "Positive end expiratory pressure (PEEP) slightly modifies ventilatory response during incremental exercise," Aviation, Space and Environmental Medicine, Jan. 2001, p. 21, vol. 72—No. 1.
Muller, "A field study of the ventilatory response to ambient temperature and pressure in sport diving," Br. J. Sports Med., 1995, vol. 29, No. 3, p. 185-190, Butterworth Heinemann.
Office Action dated Sep. 11, 2007 from U.S. Appl. No. 10/453,462, 13 pages.
Office Action dated Feb. 23, 2006 from U.S. Appl. No. 10/453,462, 11 pages.
Office Action dated Jun. 23, 2005 from U.S. Appl. No. 10/453,462, 13 pages.
Office Action dated Mar. 21,2 005 from U.S. Appl. No. 10/453,462, 5 pages.
Office Action dated Oct. 17, 2007 from U.S. Appl. No. 11/244,522, 8 pages.
Office Action dated May 24, 2007 from U.S. Appl. No. 11/244,522, 5 pages.
International Search Report from PCT/US2005/036072 dated Dec. 8, 2006, 2 pages.
International Preliminary Report on Patentability from PCT/US2005/036072 dated Apr. 11, 2007, 6 pages.
Written Opinion from PCT/US2005/036072 dated Sep. 25, 2006, 5 pages.
Office Action dated Aug. 23, 2006 from U.S. Appl. No. 11/244,522, 7 pages.
International Search Report from PCT/US2006/019658 dated Dec. 13, 2006, 2 pages.
International Preliminary Report on Patentability from PCT/US2006/019658 dated Nov. 23, 2007, 4 pages.
Written Opinion from PCT/US2006/019658 dated Oct. 28, 2006, 3 pages.
International Search Report from PCT/US2006/019659 dated Jul. 27, 2007, 2 pages.
International Preliminary Report on Patentability from PCT/US2006/019659 dated Nov. 23, 2007, 5 pages.
Written Opinion from PCT/US2006/019659 dated May 29, 2007, 4 pages.
International Search Report and Written Opinion from PCT/US2008/054475, dated Aug. 15, 2008, 11 pages.
Notice of Allowability from U.S. Appl. No. 11/244,522, dated May 14, 2010.
Notice of Allowability from U.S. Appl. No. 10/453,462, dated May 14, 2010.
Office Action dated Jul. 12, 2010 from U.S. Appl. No. 11/248,900.
Office Action from Chinese Patent Application No. 2006800176981, dated Apr. 24, 2009, 9 pages.
Office Action from Australian Patent Application No. 2006251592, dated May 7, 2009, 1 page.
Office Action from Australian Patent Application No. 2006251593, dated May 7, 2009, 1 page.
Examination Report for Singapore Patent Application No. 200717891-6, dated Jan. 29, 2009, 5 pages.
International Preliminary Report on Patentability from PCT/US0228/054475, dated Aug. 26, 2009, 8 pages.
Examination Report from Canadian Patent Application No. 2,609,479, dated Aug. 27, 2009, 4 pages.
Office Action dated Oct. 5, 2010 from U.S. Appl. No. 11/437,113.
Office Action dated Jan. 20, 2011 from U.S. Appl. No. 11/923,423.
Examination Report dated Mar. 11, 2011 from New Zealand Application No. 563367.
Examination Report dated Mar. 14, 2011from New Zealand Application No. 563368.

* cited by examiner

EXHALATION VALVE FOR USE IN AN UNDERWATER BREATHING DEVICE

CROSS REFERENCE TO RELATED APPLICATIONS

This application is a continuation-in-part of U.S. patent application Ser. No. 11/437,113, entitled "Exhalation Valve For Use In An Underwater Breathing Device," filed on May 18, 2006, which is a continuation-in-part of U.S. patent application Ser. No. 10/453,462, entitled "Underwater Breathing Devices And Methods," filed on Jun. 3, 2003, which claims priority to and the benefit of U.S. provisional patent application Ser. No. 60/385,327, filed Jun. 3, 2002. U.S. patent application Ser. No. 11/437,113 also claims priority to and the benefit of U.S. provisional patent application Ser. No. 60/683,477, entitled "Valves, Baffles, Shortened Snorkels, Stealth Snorkels, Snorkel Equipment Combined with Scuba Equipment," filed on May 21, 2005, and U.S. provisional patent application Ser. No. 60/728,193, entitled "Snorkel Valve," filed on Oct. 19, 2005. This application also claims priority to and the benefit of U.S. provisional patent application Ser. No. 60/890,795, entitled "Membrane Flow Contour Feature," filed on Feb. 20, 2007. Each of these applications is hereby expressly incorporated by reference herein in its entirety.

BACKGROUND OF INVENTION

1. Field of Invention

The present invention relates generally to an underwater breathing device and, in particular, to an exhalation valve for use in an underwater breathing device that is configured to produce positive end-expiratory pressure in the airway of a user.

2. Description of Related Art

An underwater breathing device enables a user to continue breathing even after the user's mouth and/or nose is submerged in water. Some underwater breathing devices, such as scuba and snuba breathing devices, are configured to provide a submerged user with air from a compressed-air source. Other underwater breathing devices, such as a conventional snorkel, are configured to provide a user with air from the atmosphere.

A conventional snorkel generally includes a breathing tube through which air can be inhaled from the atmosphere. The breathing tube is typically configured with two ends. One end of the snorkel is intended to remain above the surface of the water. The other end of the snorkel is intended to be submerged under the surface of the water. The end of the breathing tube that is intended to be submerged generally includes a mouthpiece. In practice the user inserts a portion of the mouthpiece into his mouth and thereby creates a seal between the user's airway and the breathing tube. The user then submerges his mouth and the mouthpiece under water while maintaining the other end of the breathing tube above the surface of the water, thereby enabling the user to inhale atmospheric air while submerged in water. At the same time, the breathing tube enables the user to exhale through the user's mouth without breaking the seal between the user's mouth and the mouthpiece. Generally, the air exhaled by a user exits the snorkel through the same breathing tube through which the user inhales atmospheric air.

One problem that a user can encounter while using a conventional snorkel is increased fatigue due to the compressive forces of the ambient water in which the user is submerged. During normal inhalation and exhalation, a user expends effort inflating and deflating his lungs. When a user is submerged in water, however, the compressive forces of the ambient water around the user's chest force the user to expend more effort than usual in order to inflate his lungs and tend to cause the user to expend less effort than usual to deflate his lungs. This reduced-effort exhalation tends to cause the user to exhale faster than normal and down to smaller residual lung volumes than normal such that there is less time between each inhalation, resulting in more frequent inhalation. More frequent inhalation can cause the user's inhalation muscles to fatigue relative to normal inhalation and exhalation, which can result in a smaller functional lung capacity, the possibility of atelectasis, and increased breathing difficulty.

Another problem that a user can encounter while using a conventional snorkel is difficulty breathing due to water being present in the breathing tube of the snorkel. Water can sometimes enter a conventional snorkel through one or both ends of the breathing tube. This water can cause difficulty breathing when it accumulates to the point where the water interferes with the passage of air in the breathing tube and/or the water is inhaled by the user. In addition, the presence of water in the breathing tube of the snorkel can cause a distracting gurgling or bubbling noise as air passes by the water during inhalation and/or exhalation.

BRIEF SUMMARY OF EXAMPLE EMBODIMENTS

A need therefore exists for an underwater breathing device that eliminates or reduces some or all of the above-described problems.

One aspect is an exhalation valve that may be used in an underwater breathing device. The exhalation valve is potentially configured to produce positive end-expiratory pressure in the airway of a user of the underwater breathing device. The exhalation valve may include a plate defining an exhalation port and at least one chamber port, an exhalation conduit connected to the exhalation port, and a flexible membrane that is sealable against a surface of the plate. A lower portion of the exhalation conduit may be divided by a septum which divides the exhalation conduit and the exhalation port into a first exhalation port connected to a first exhalation conduit and a second exhalation port connected to a second exhalation conduit. The flexible membrane may be sized and positioned to be capable of sealing the first exhalation port and the second exhalation port. The flexible membrane can be configured to have a fully-sealed position, a partially-sealed position, and an unsealed position. In the fully-sealed position, the flexible membrane seals the first and second exhalation ports such that substantially no air nor water can flow through the first nor the second exhalation ports. In the partially-sealed position, the flexible membrane seals the second exhalation port but does not seal the first exhalation port such that air and water can flow from the chamber port(s) through the first exhalation port and substantially no water can flow from the second exhalation conduit through the second exhalation port. In the unsealed position, the flexible membrane does not seal the first nor second exhalation ports such that air and water can flow from the chamber port(s) through the first and second exhalation ports.

Another aspect is an exhalation valve that may include a plate defining a chamber port or ports and an exhalation conduit connected to the plate with each of the chamber ports having a sidewall oriented substantially parallel to the orientation of a sidewall of the exhalation conduit. Further, the first exhalation port and the first exhalation conduit may be substantially crescent-shaped and the second exhalation port and the second exhalation conduit may be substantially marquise-shaped. Moreover, a volume defined by the first exhalation conduit may be less than a volume defined by the second exhalation conduit. In addition, the flexible membrane may further include a first protrusion formed on the flexible membrane that is sized and positioned such that the first protrusion extends into the first exhalation conduit when the flexible membrane is in the fully-sealed position. Also, the flexible membrane may further include a second protrusion formed on the flexible membrane that is sized and positioned such that the second protrusion extends into the second exhalation conduit when the flexible membrane is in the fully-sealed position or in the partially-sealed position. The first protrusion may be sized and positioned to bias against a sidewall of the first exhalation conduit as the flexible membrane transitions to the fully-sealed position in order to dampen vibration in the flexible membrane. The second protrusion may be sized and positioned to bias against the septum as the flexible membrane transitions to the fully-sealed position or into the partially-sealed position in order to dampen vibration in the flexible membrane. Further, the largest open dimension of the chamber port(s) may be smaller than the largest open dimension of the second exhalation port.

Yet another aspect is an underwater breathing device that may be configured to produce positive end-expiratory pressure in the airway of a user of the underwater breathing device. The underwater breathing device may include a chamber and a valve. The chamber may include a breathing port and an exhalation port. The chamber may be configured such that when air is being exhaled through the breathing port into the chamber in a manner that restricts air from simultaneously escaping through the breathing port, there is no unrestricted passageway out of the chamber through which air can exit the underwater breathing device and, as a result, the exhaled air creates an exhalation pressure within the chamber. The valve may include a plate defining an exhalation port, an exhalation conduit connected to the exhalation port, and a flexible membrane that is sealable against a surface of the plate. A lower portion of the exhalation conduit may divided by a septum which divides the exhalation conduit and the exhalation port into a first exhalation port connected to a first exhalation conduit and a second exhalation port connected to a second exhalation conduit. The flexible membrane may be sized and positioned to be capable of sealing the first exhalation port and the second exhalation port. The flexible membrane may be configured such that an opening force, comprising any exhalation pressure within the chamber, biases the flexible membrane in a first direction and a closing force biases the flexible membrane in a second direction, the first direction being substantially opposite the second direction. The flexible membrane may be configured to have a fully-sealed position, a partially-sealed position, and an unsealed position. In the fully-sealed position, the flexible membrane seals the first and second exhalation ports such that substantially no air nor water can flow through the first and second exhalation ports. In the partially-sealed position, the flexible membrane seals the second exhalation port but does not seal the first exhalation port such that air and water can flow from the chamber port(s) through the first exhalation port and substantially no water can flow from the second exhalation conduit through the second exhalation port. In the unsealed position, the flexible membrane does not seal the first and second exhalation ports such that air and water can flow from the chamber port(s) through the first and second exhalation ports.

A further aspect is that the closing force of an underwater breathing device may include ambient water pressure when at least a portion of the underwater breathing device is submerged in water. In addition, the opening force of an underwater breathing device may further include a biasing pressure of the flexible membrane. Moreover, a volume defined by the second exhalation conduit may be at least twice the volume defined by the first exhalation conduit.

Yet another aspect is an underwater breathing device configured to produce positive end-expiratory pressure in the airway of a user of the underwater breathing device. The underwater breathing device may include a chamber and a valve. The chamber may include a breathing port and an exhalation port. The chamber may be configured such that when air is being exhaled through the breathing port into the chamber in a manner that restricts air from simultaneously escaping through the breathing port, there is no unrestricted passageway out of the chamber through which air can exit the underwater breathing device and, as a result, the exhaled air creates an exhalation pressure within the chamber. The valve may be configured to restrict airflow from the chamber through the exhalation port such that, when the chamber is submerged in water, any exhalation pressure within the chamber combined with a biasing pressure of the valve biases the valve in a first direction and ambient water pressure biases the valve in a second direction, with the first direction being substantially opposite the second direction. The valve may be configured to have a fully-sealed position and an unsealed position. When in the fully-sealed position, substantially no air nor water can flow through the exhalation port. The valve may be disposed in the fully-sealed position when any exhalation pressure within the chamber combined with a biasing pressure of the valve is substantially less than the ambient water pressure. When in the unsealed position, air and water can flow from the chamber through the exhalation port. The valve may be disposed in the unsealed position when any exhalation pressure within the chamber combined with a biasing pressure of the valve is substantially greater than the ambient water pressure.

Still another aspect is an underwater breathing device that includes a valve configured to have a partially-sealed position. When in the partially-sealed position, air and water can flow from the chamber through the first exhalation port but not through the second exhalation port. The valve may be disposed in the partially-sealed position when any exhalation pressure within the chamber combined with a biasing pressure of the valve is substantially equal to the ambient water pressure.

These and other aspects of example embodiments of the present invention will become more fully apparent from the following detailed description of example embodiments.

BRIEF DESCRIPTION OF DRAWINGS

The appended drawings contain figures of example embodiments to further clarify the above and other aspects of the present invention. It will be appreciated that these drawings depict only example embodiments of the invention and are not intended to limit its scope. These example embodiments of invention will be described and explained with additional specificity and detail through the use of the accompanying drawings in which.

DETAILED DESCRIPTION OF EXAMPLE EMBODIMENTS

Example embodiments of the invention are generally directed toward an exhalation valve for use in an underwater breathing device. The exhalation valve is configured to produce positive end-expiratory pressure in the airway of a user of the underwater breathing device and to minimize or eliminate a gurgle that can occur upon exhalation if water is present in the path of the exhaled air. Example embodiments of the present invention, however, are not limited to underwater breathing devices. It will be understood that, in light of the present disclosure, the structures disclosed herein can be successfully used in connection with any device that is intended to produce positive end-expiratory pressure in the airway of a user or to reduce a gurgle in any such device. For example, the structures disclosed herein can be employed in scuba or snuba equipment to provide positive end-expiratory pressure, or may be used in connection with ventilator tubing for patients in a hospital to reduce a gurgle in said tubing.

Additionally, to assist in the description of the exhalation valve, words such as top, bottom, front, rear, right, left and side are used to describe the accompanying figures, which are not necessarily drawn to scale. It will be appreciated, however, that the example embodiments of the present invention disclosed herein can be located in a variety of desired positions within an underwater breathing device or other device—including various angles, sideways and even upside down. A detailed description of the exhalation valve for use in an underwater breathing device now follows.

As discussed below and shown in the accompanying figures, the exhalation valve may be used in connection with an underwater breathing device such as a scuba or snuba regulator, or a snorkel. For example, the exhalation valve may function in connection with an inhalation valve of a snorkel, or the exhalation valve may be combined with the inhalation valve. The exhalation valve may be placed at the top or the bottom of the breathing conduit of a snorkel, whether the snorkel includes only a single breathing conduit, or includes both an inhalation channel and an exhalation channel. The exhalation valve is generally configured to open when the user of the snorkel exhales to allow the exhaled air to exit the snorkel. The exhalation valve is also generally configured to close when the user of the snorkel is not exhaling, as during inhalation or between breaths. Where the snorkel includes both an inhalation channel and an exhalation channel, the closed exhalation valve may prevent exhaled air remaining within the exhalation channel from passing back into the inhalation channel, thereby directing the exhaled air through the proper exhalation channel. It may also prevent water present in the exhalation channel from entering the inhalation channel, thus avoiding the aspiration of water by the user of the snorkel.

1. Example Snorkel

Figure 1A:
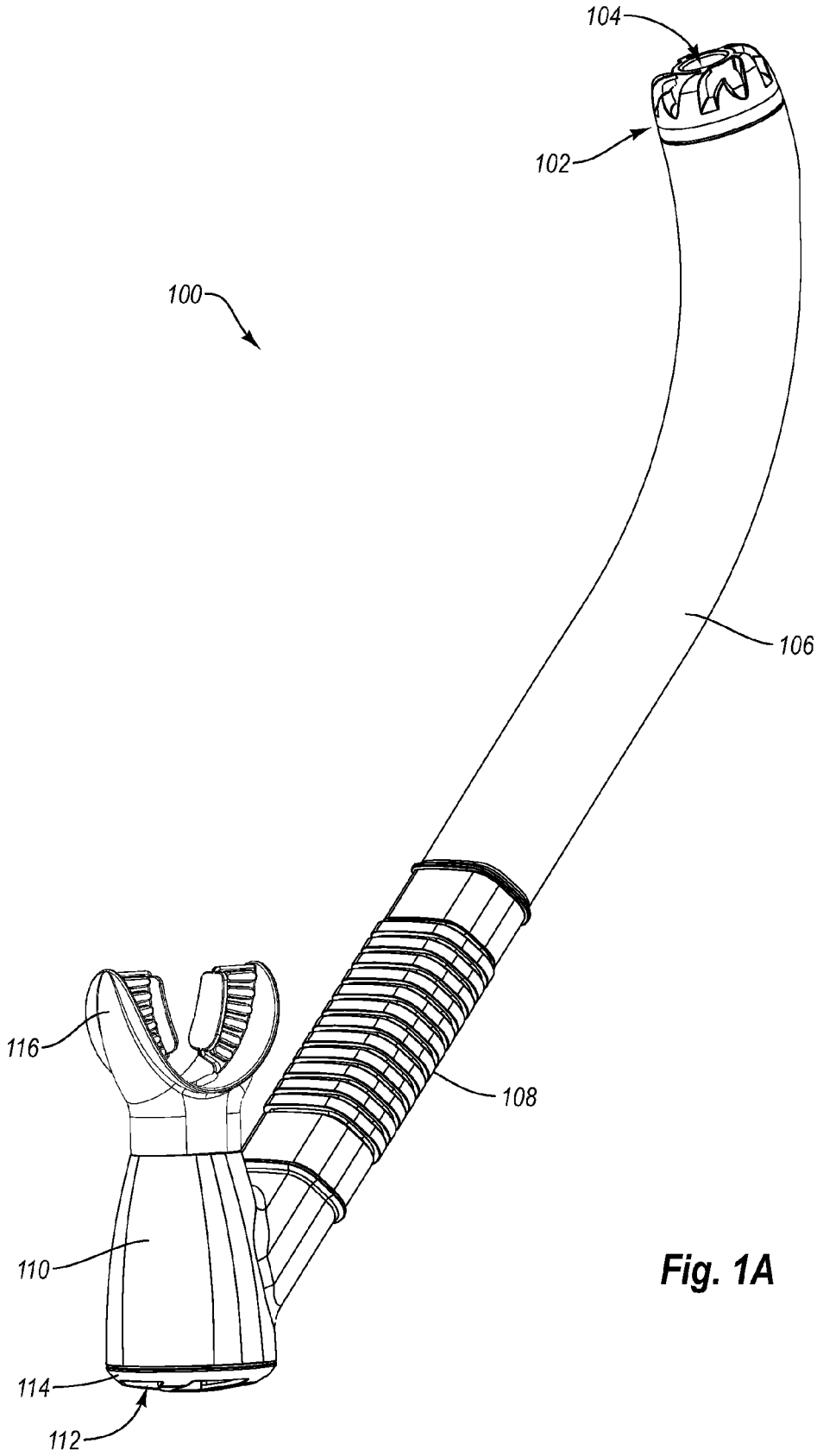
FIG. 1A is a perspective view of an example assembled snorkel.
Figure 1B:
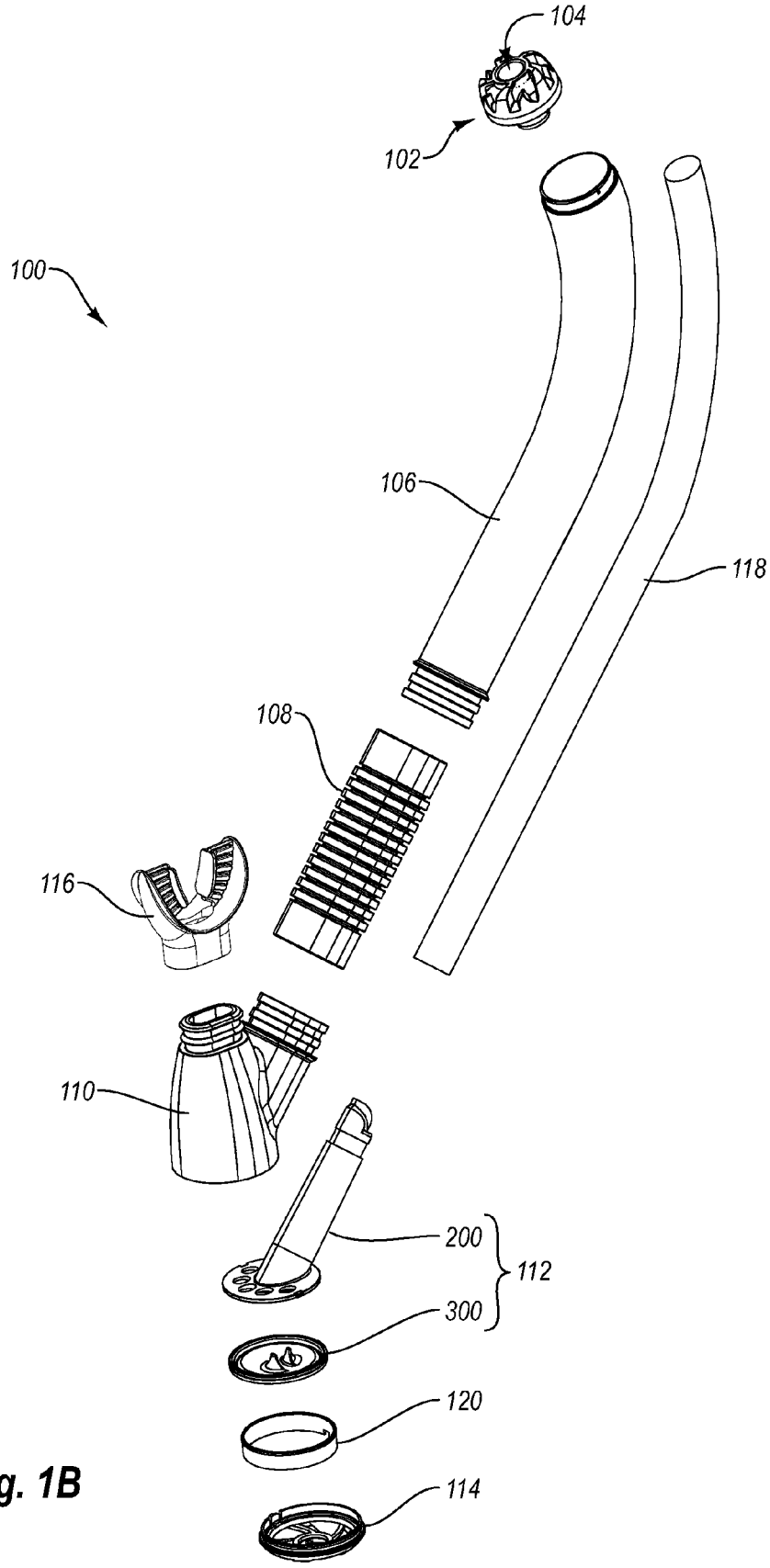
FIG. 1B is a perspective exploded view of the example snorkel of FIG. 1A.

Turning now to FIGS. 1A and 1B, an example snorkel 100 is disclosed. In general, the snorkel 100 facilitates inhalation through an inhalation channel (which generally includes an inhalation valve 102 and portions of a main tube 106, a connecting tube 108, and a junction 110) to a mouthpiece 116 of the user, and exhalation goes from the mouthpiece 116 to an exhalation channel (which generally includes portion of the junction 110 and an exhalation valve 112, an exhalation tube 118, and an exhalation exit port 104) from which exhaled air exits the snorkel 100. The snorkel 100 includes an inhalation valve 102 and an exhalation valve 112. When the snorkel 100 is in use, atmospheric air flows one-way across the inhalation valve 102 and through the inhalation channel to the mouthpiece 116 where it is inhaled by the user. The air that is subsequently exhaled by the user then flows across the exhalation valve 112 and through the exhalation channel where the exhaled air exits the snorkel 100. Additional details regarding example structures for the inhalation channel, the mouthpiece, and the exhalation channel now follow.

As disclosed in FIG. 1A, the snorkel 100 includes an inhalation valve 102, an exhalation exit port 104, a main tube 106, a connecting tube 108, a junction 110, an exhalation valve 112, a bottom cap 114, and a mouthpiece 116. The inhalation valve 102 is attached to top end of the main tube 106 and allows air to be inhaled into the snorkel 100. The inhalation valve may be configured similar to the check valve disclosed in United States patent application publication no. 2006/0260703 titled "Check Valve," the disclosure of which is incorporated herein by reference in its entirety.

The connecting tube 108 connects a bottom end of the main tube 106 to the junction 110. The exhalation valve 112 is generally enclosed within the junction 110 and allows air to be exhaled out of the snorkel though the exhalation exit port 104. The bottom cap 114 is attached to the bottom of the junction 110 and allows ambient water pressure from the water into which the snorkel 100 is partially submerged to interact with an exhalation valve 112, as discussed elsewhere herein. The mouthpiece 116 is attached to the top of the junction 110 and allows a user to breathe in air that entered the snorkel 100 through inhalation valve 102 and breathe out air that can exit the snorkel through the exhalation valve 112 and the exhalation exit port 104.

As disclosed in FIG. 1B, the snorkel 100 further includes an exhalation tube 118, a sleeve 120, a lower mount 200, and a flexible membrane 300. As disclosed in FIG. 1B, the exhalation tube 118 connects the lower mount 200 and the exhalation exit port 104 that is defined in the inhalation valve 102 in order to allow exhaled air, along with any water that has inadvertently entered the snorkel, to exit the snorkel 100 through the exhalation exit port 104. The bottom cap 114 and the lower mount 200 can be employed to attach the flexible membrane 300 to a surface of the lower mount 200. The flexible membrane 300 is sealable against a surface of the lower mount 200 and is sized and positioned to be capable of sealing the exhalation tube 118 in order to produce positive end-expiratory pressure in the airway of a user of the snorkel 100.

The positive end-expiratory pressure produced by the exhalation valve 112 may reduce the overall work of underwater breathing. Further, the positive end-expiratory pressure may help to preserve lung volumes by reducing inhalation muscle fatigue caused by underwater breathing. In addition, the positive end-expiratory pressure may also improve the gas exchange function of alveolar air sacs and related structures in the lungs. Moreover, the positive end-expiratory pressure may also reduce the resting respiratory rate of a user during underwater breathing. Additionally, the positive end-expiratory pressure may also lengthen comfortable single-breath dive times by protecting lung volumes and improving alveolar gas exchange.

2. Example Exhalation Valve Lower Mount

Figure 2A:
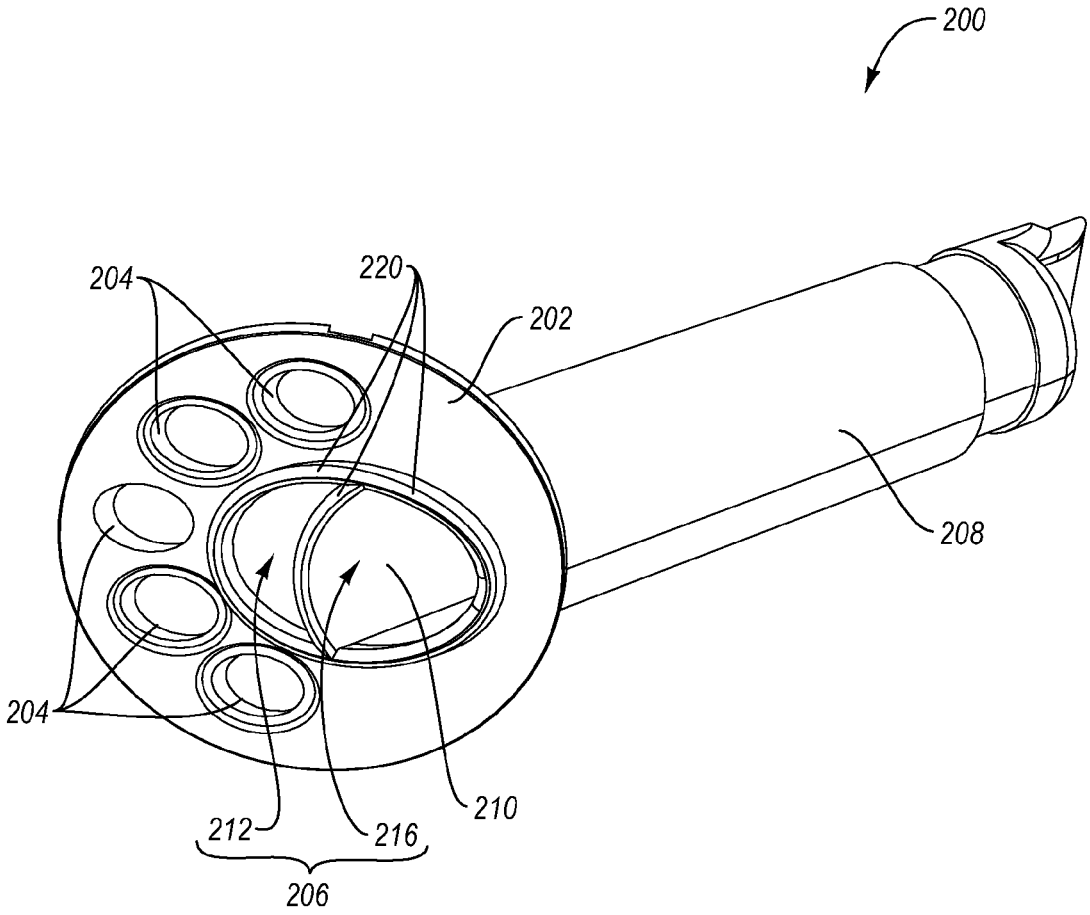
FIG. 2A is a perspective view of an example lower mount.
Figure 2B:
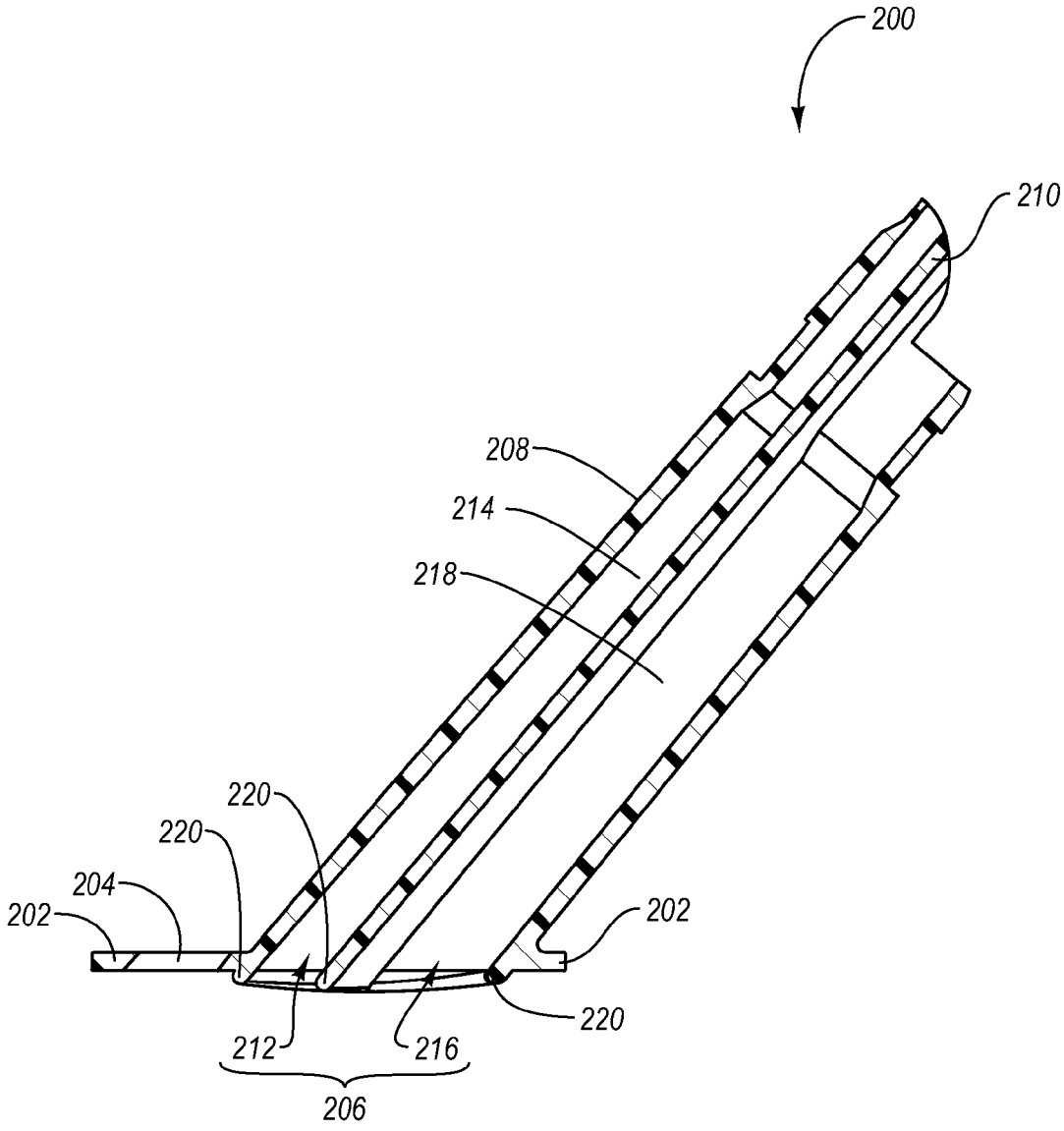
FIG. 2B is a cross-sectional perspective view of the example lower mount of FIG. 2A.
Figure 2C:
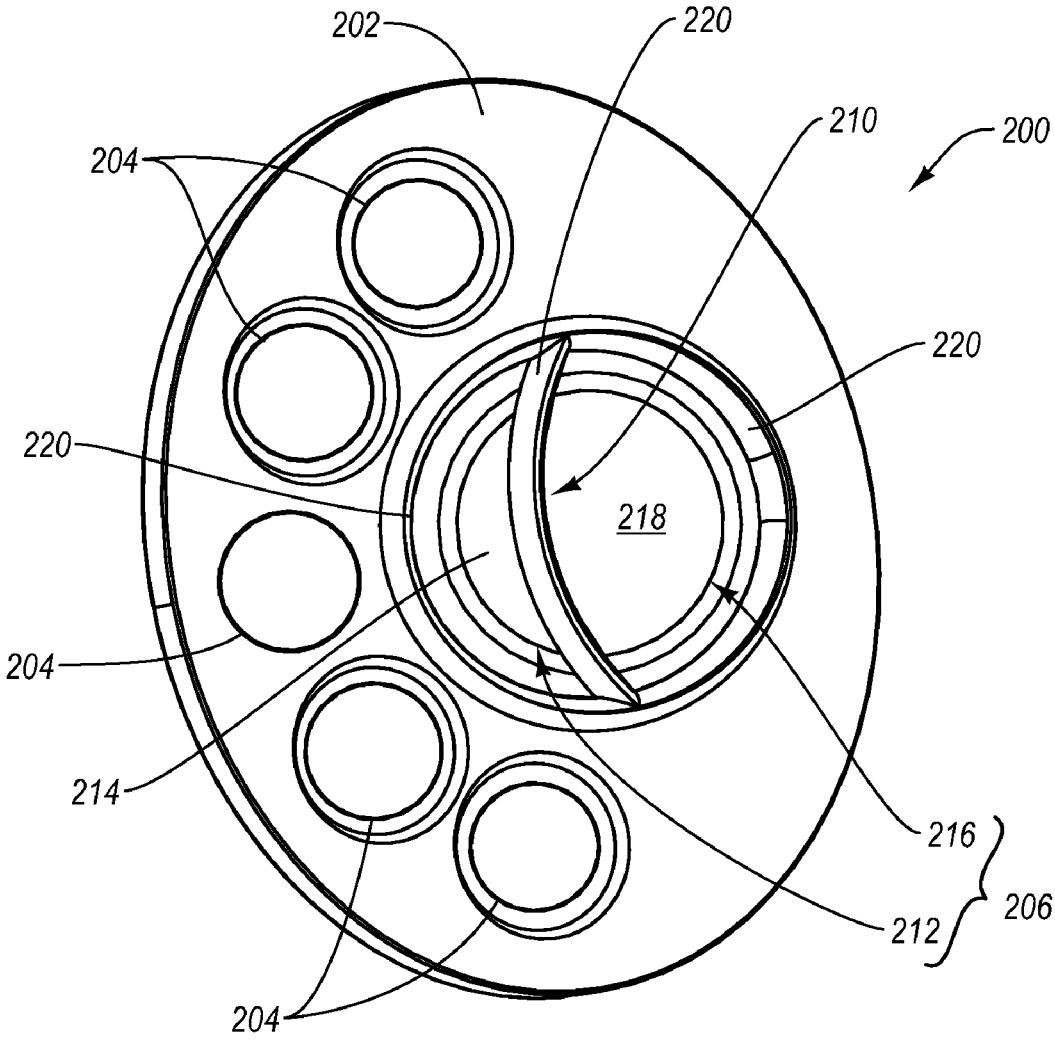
FIG. 2C is another cross-sectional view of the example lower mount of FIG. 2A.

With reference now to FIGS. 2A-2C, additional aspects of the lower mount 200 will be disclosed. As disclosed in FIG. 2A, the lower mount 200 includes a plate 202. The plate 202 defines several chamber ports 204. Although the plate 202 is disclosed as defining five chamber ports 204 that are each substantially circle-shaped or oval-shaped, it is understood that other numbers of chamber ports having other shapes are possible and contemplated. In addition, the chamber ports 204 may be sized and configured to prevent pebbles or other large debris that may inadvertently enter the snorkel 100, through the mouthpiece 116 for example, from becoming lodged in the exhalation valve 112 or the exhalation tube 118 (see FIG. 1B). For example, the largest open dimension of each of the chamber ports 204 may be smaller than the largest open dimension of the second exhalation ports 216 in order to assure that any pebbles or other large debris do not lodge in the second exhalation port 216 or the second exhalation conduit 218, discussed below.

The plate 202 also defines an exhalation port 206. The lower mount 200 also includes an exhalation conduit 208 connected to the exhalation port 206. As disclosed in FIGS. 2A and 2B, a lower portion of the exhalation conduit 208 is divided by a septum 210 which divides the exhalation conduit 208 and the exhalation port 206 into a first exhalation port 212 connected to a first exhalation conduit 214 and a second exhalation port 216 connected to a second exhalation conduit 218. It is noted that the sidewall of each of the chamber ports 204 is oriented substantially parallel to the orientation of the inside sidewall of the exhalation conduit 208 (best shown in the middle chamber port 204 in FIG. 3A). This parallel orientation may enable the chamber ports 204 to be molded using the same mold slider (not shown) as the inside sidewall of the exhalation conduit 208.

As disclosed in FIGS. 2A and 2C, the septum 210 may be curved and located off-center within the exhalation conduit 208, which results in the first exhalation port 212 and the first exhalation conduit 214 being substantially crescent-shaped and the second exhalation port 216 and the second exhalation conduit 218 being substantially marquise-shaped. The curved shape and off-center position of the septum 210, in this embodiment, also results in a volume defined by the first exhalation conduit 214 being less than a volume defined by the second exhalation conduit 218. In particular, in some example embodiments, the volume defined by the second exhalation conduit 218 may be at least twice the volume defined by the first exhalation conduit 214. This increased volume of the second exhalation conduit 218 may result in increased storage capacity for trapped water, as discussed below in connection with FIG. 4C.

Also disclosed in FIGS. 2A and 2B is an optional rib 220 that circumscribes the perimeters of the first exhalation port 212 and the second exhalation port 216, including the exposed edge of the septum 210. As disclosed in FIG. 2B, the rib 220 extends below another surface of the plate 202 and, as such, the rib 220 functions as a gasket to effect a better seal between the first and second exhalation ports 212 and 216 and the flexible membrane 300 (as disclosed, for example, in FIGS. 4A and 4B). The rib 220 may function, therefore, as a surface of the plate 202 against which the flexible membrane 300 may seal (as disclosed, for example, in FIGS. 4A and 4B).

3. Example Exhalation Valve Flexible Membrane

Figure 3A:
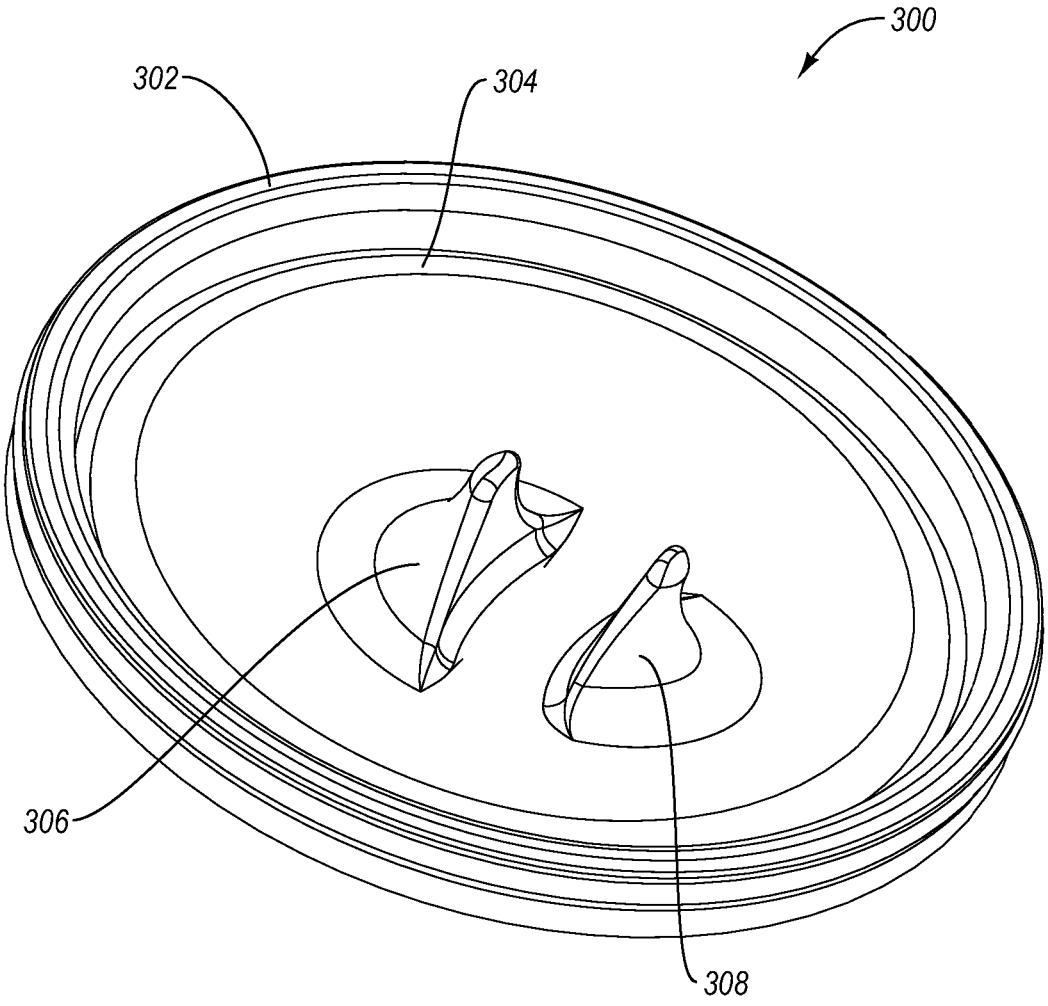
FIG. 3A is a perspective view of an example flexible membrane.
Figure 3B:
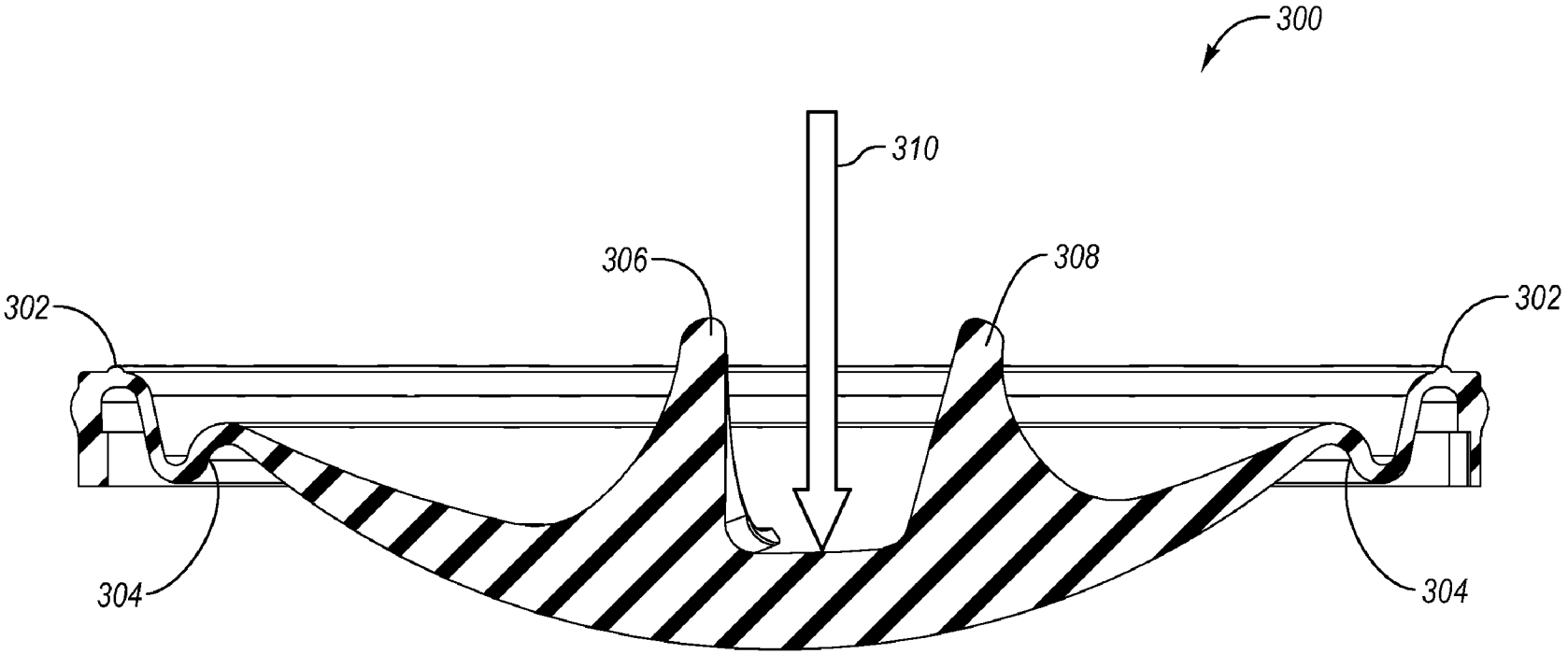
FIG. 3B is a cross-sectional view of the example flexible membrane of FIG. 3A.

With reference now to FIGS. 3A and 3B, additional aspects of the flexible membrane 300 will be disclosed. As disclosed in FIG. 3A, the flexible membrane 300 includes an outer rim 302, an inner expandable fold 304, a first protrusion 306, and a second protrusion 308. The outer rim 302 is configured to be attached to the plate 202 of the lower mount 200 (see FIG. 2A) and to maintain an air-tight and water-tight seal with the plate 202. The inner expandable fold 304 is configured to allow the membrane 300 to expand when overcome by exhalation from a user and contract when overcome by the ambient water pressure of the water in which the snorkel 100 is partially or fully submerged. The generally downward curve of the membrane 300 disclosed in FIG. 3B results in a downward biasing pressure 310 of the flexible membrane that helps to counteract the upward force of the ambient water pressure. Additional aspects of the first protrusion 306 and the second protrusion 308 will be disclosed below in connection with FIGS. 4A-4D.

Figure 3C:
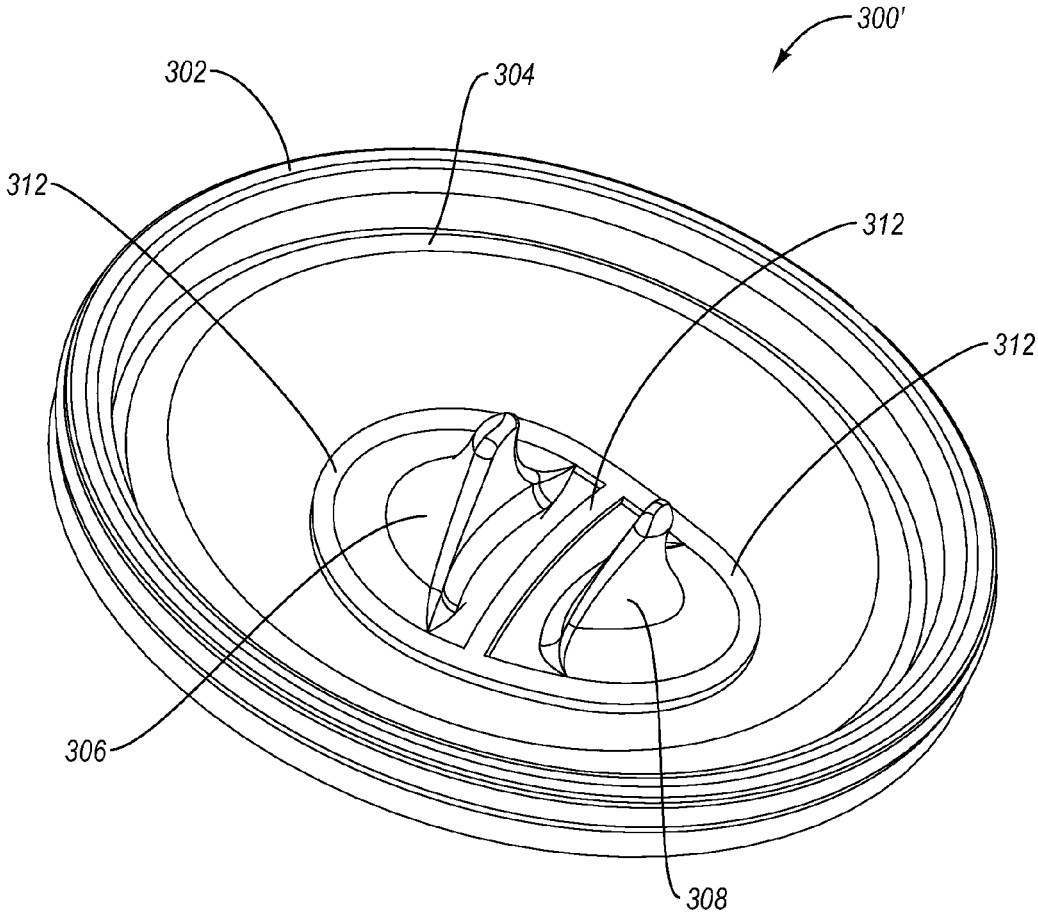
FIG. 3C is a cross-sectional view of another example flexible membrane.

With reference now to FIG. 3C, an alternative flexible membrane 300' is disclosed. The flexible membrane 300' is substantially identical to the flexible membrane 300 of FIGS. 3A and 3B except that the flexible membrane 300' includes a rib 312 that circumscribes the perimeter of the first protrusion 306 and the second protrusion 308 so as to correspond to the perimeter of the first exhalation port 212 and the second exhalation port 216 disclosed in FIG. 2A. As disclosed in FIG. 3C, the rib 312 extends above the top surface of the flexible membrane 300' and, as such, the rib 312 functions as a gasket to effect a better seal between the flexible membrane 300' and the first and second exhalation ports 212 and 216 (see FIG. 2A). It is understood that the rib 312 may be employed instead of, or in combination with, the rib 220 disclosed in FIGS. 2A and 2B.

4. Example Exhalation Valve Operation

Figure 4A:
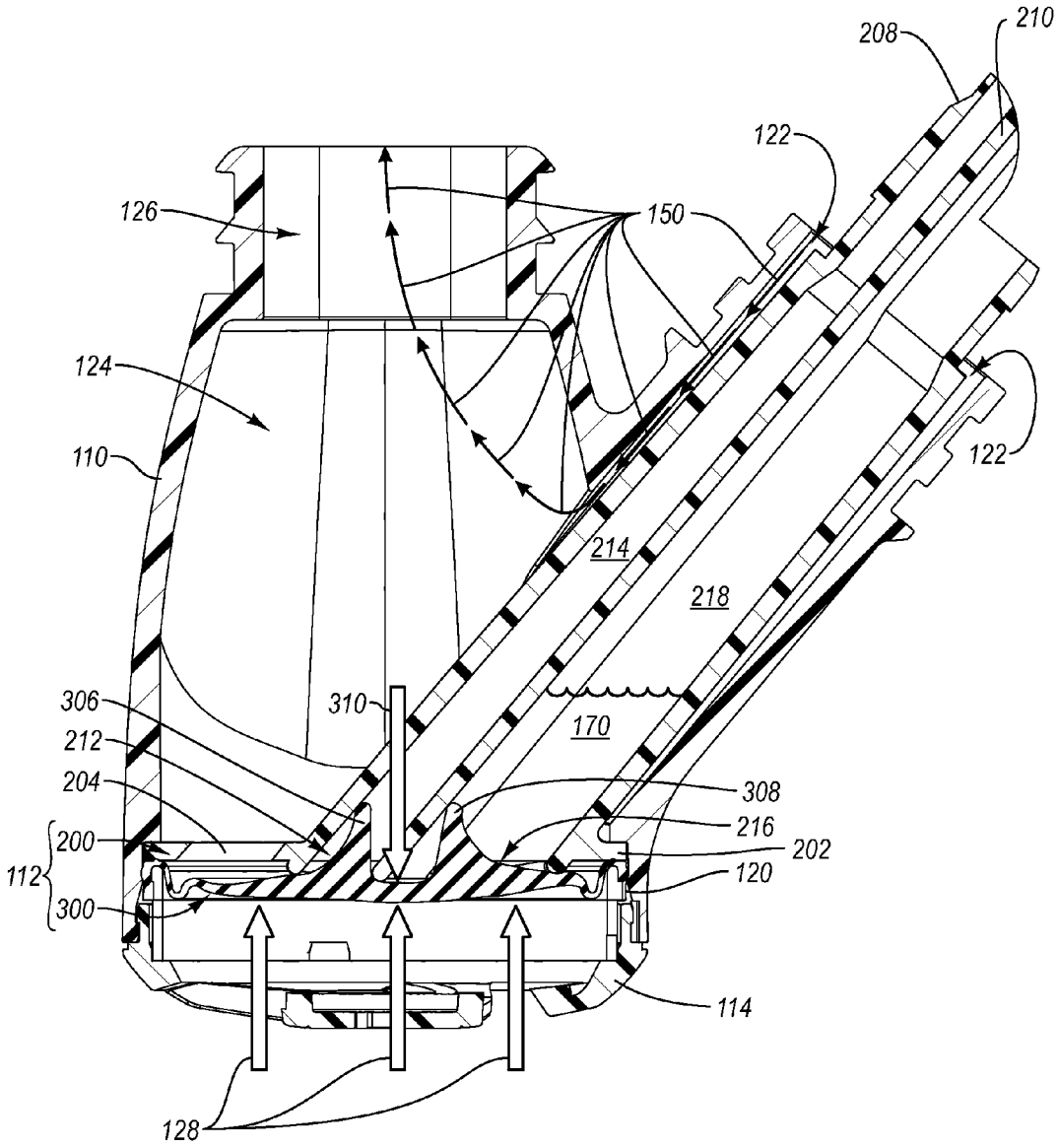
FIG. 4A is a cross-sectional view of an example exhalation valve comprising the example lower mount of FIGS. 2A-2C and the example flexible membrane of FIGS. 3A and 3B assembled together with an example junction, showing the exhalation valve in a fully-sealed position during inhalation.
Figure 4B:
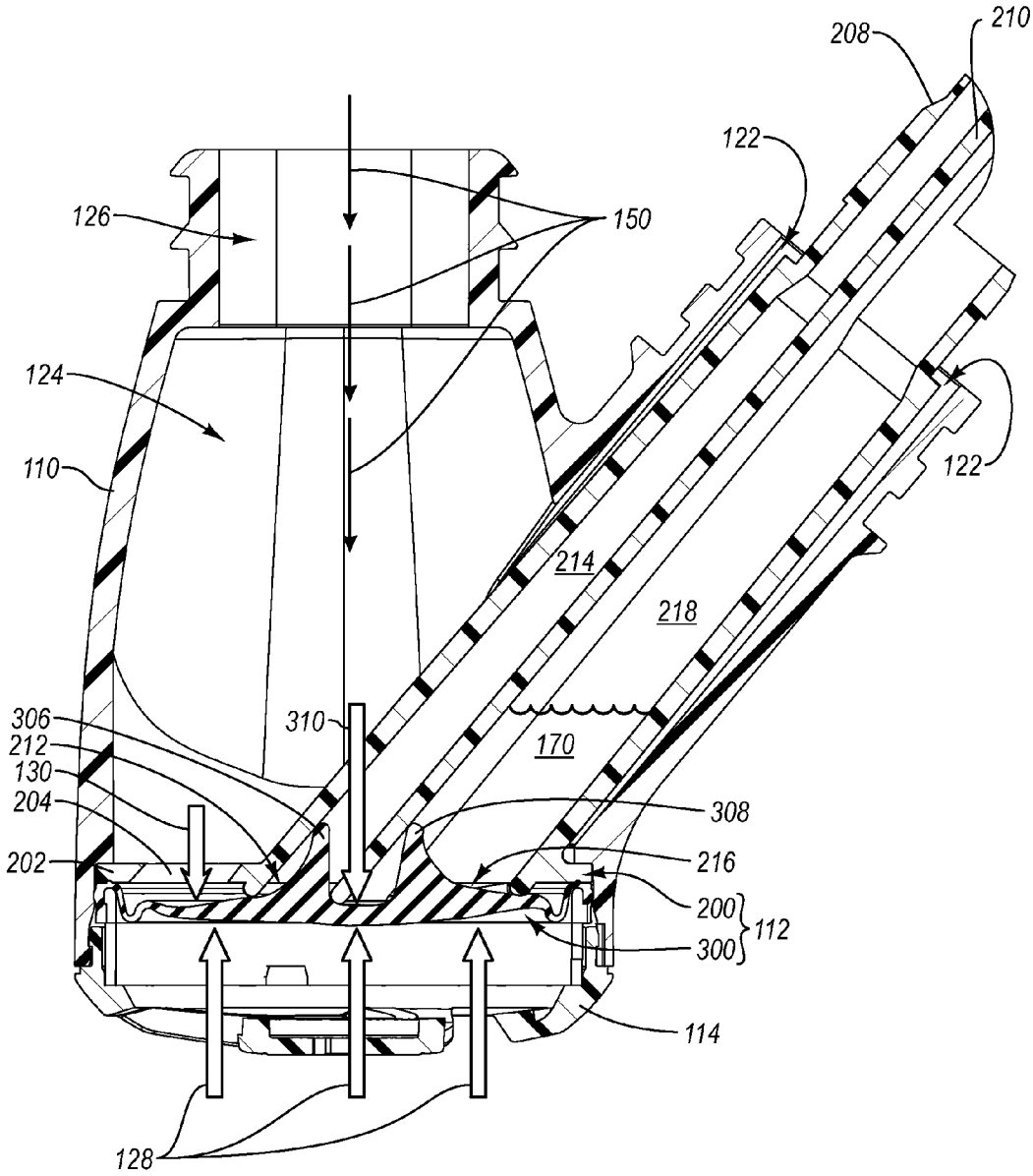
FIG. 4B is a cross-sectional view of the example exhalation valve and the example junction of FIG. 4A, showing the exhalation valve in a fully-sealed position during a beginning stage of normal exhalation.
Figure 4C:
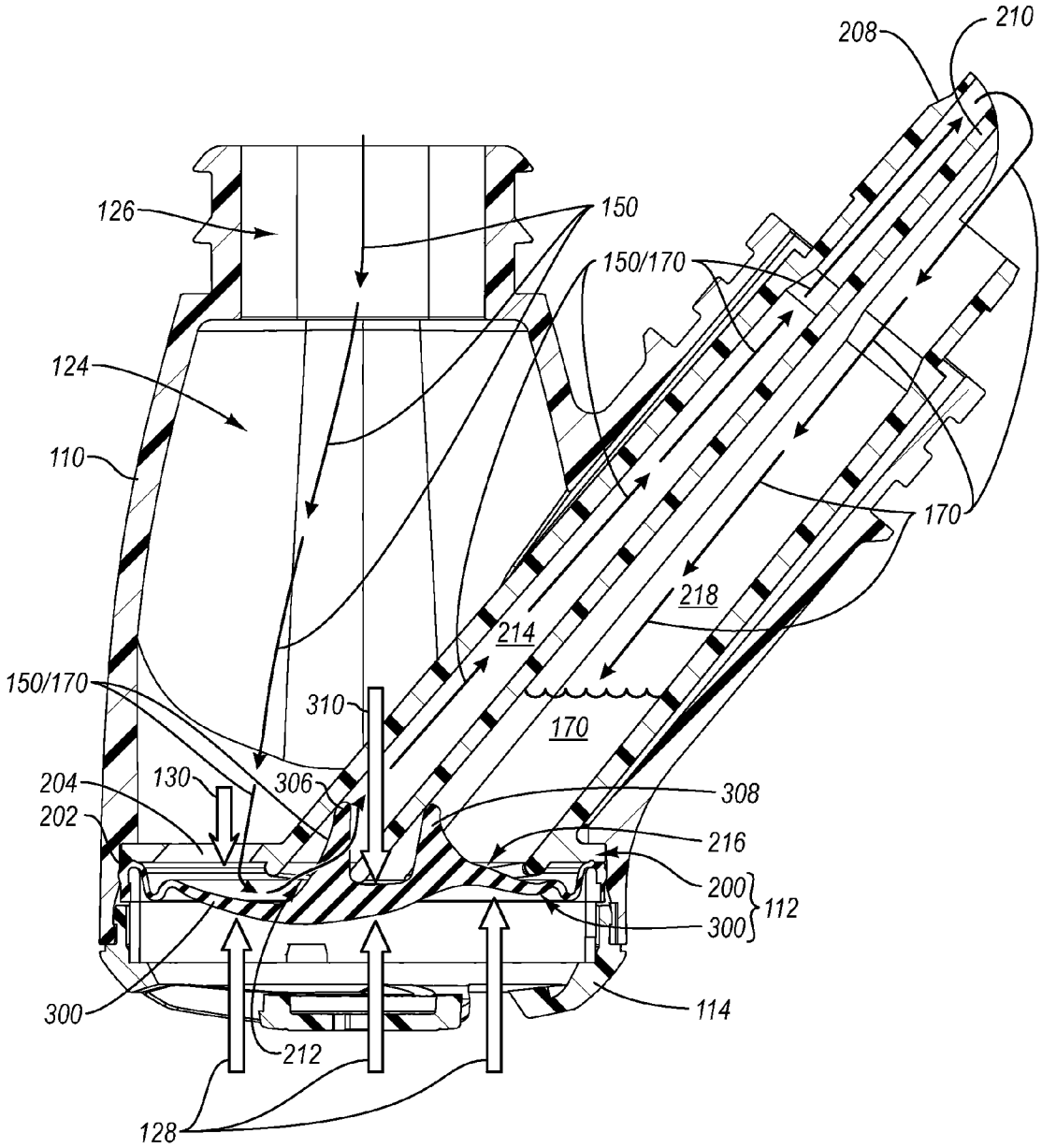
FIG. 4C is a cross-sectional view of the example exhalation valve and the example junction of FIG. 4A, showing the exhalation valve in a partially-sealed position during a later state of normal exhalation.
Figure 4D:
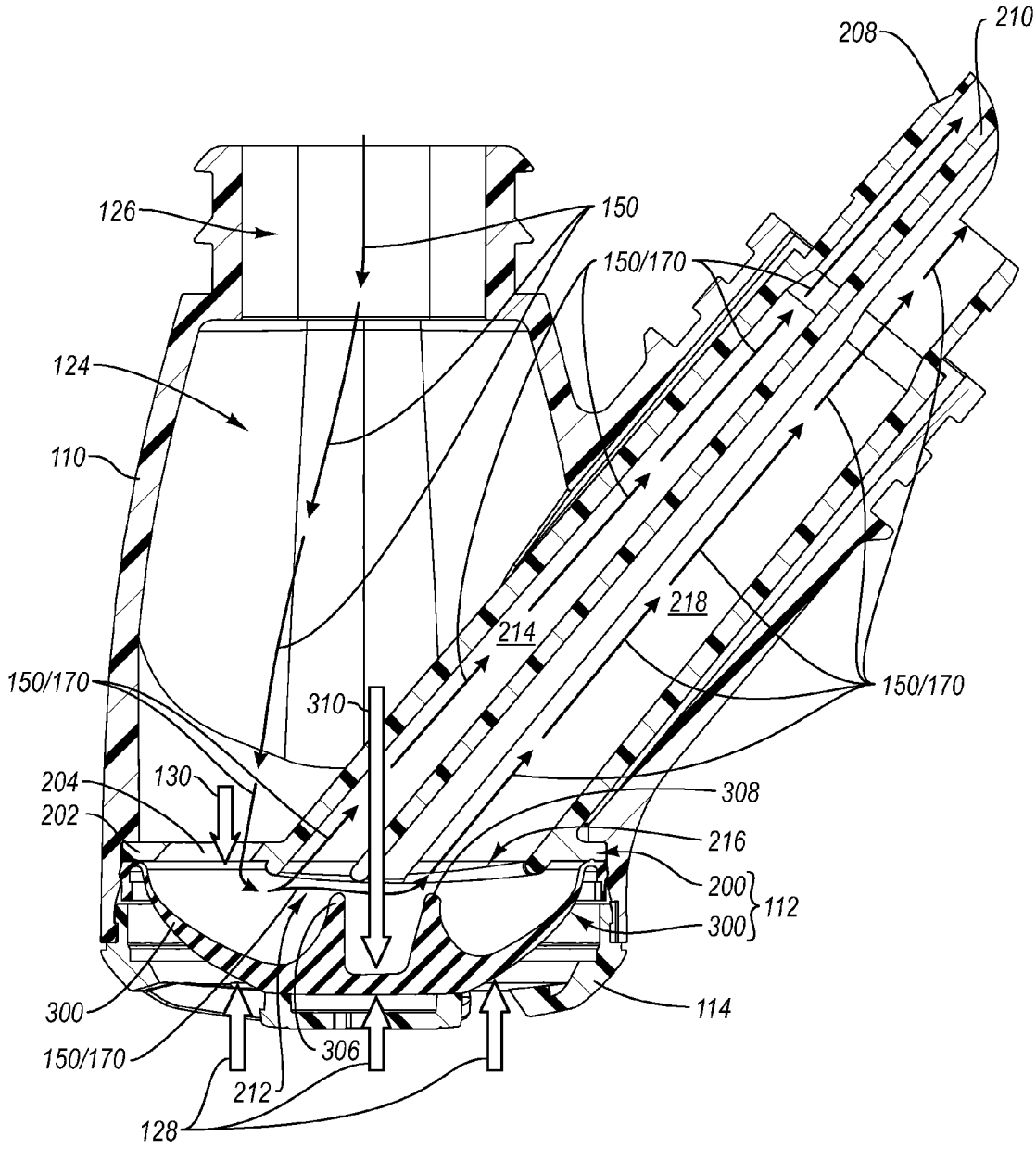
FIG. 4D is a cross-sectional view of the example exhalation valve and the example junction of FIG. 4A, showing the exhalation valve in an unsealed position during forceful exhalation.

With reference now to FIGS. 4A-4D, additional aspects of the operation of the exhalation valve 112 will be disclosed. In particular, FIG. 4A shows the exhalation valve 112 in a fully-sealed position during inhalation, FIG. 4B shows the exhalation valve 112 in a fully-sealed position during a beginning stage of normal exhalation, FIG. 4C shows the exhalation valve 112 in a partially-sealed position during a later stage of normal exhalation, and FIG. 4D shows the exhalation valve 112 in an unsealed position during forceful exhalation. The operation of the snorkel 100 will now be disclosed in connection with FIGS. 4A-4D. The following discussion assumes that the snorkel is in use by a user who is partially submerged in water with the inhalation valve 102 extending up above the surface of the water.

a. Inhalation

With reference first to FIG. 4A, the operation of the snorkel 100 during inhalation is disclosed. As a user of the snorkel 100 inhales, air 150 passes into the snorkel 100 through the inhalation valve 102 (see FIGS. 1A and 1B). The air 150 next passes through the main tube 106 and the connecting tube 108 (see FIGS. 1A and 1B), where it enters an inhalation conduit 122 defined by the junction 110 and into a chamber 124 also defined by the junction 110. The air 150 then passes through a breathing port 126 defined by the junction 100 and into the user's mouth and lungs by way of the mouthpiece 116 (see FIGS. 1A and 1B).

During inhalation, as disclosed in FIG. 4A, the ambient water pressure 128 of the water surrounding the snorkel 100 pushes the flexible membrane 300 against the plate 202, thus sealing the first and second exhalation ports 212 and 216 in a "fully-sealed position." In the fully-sealed position, substantially no previously exhaled air nor any water can flow from the first nor the second exhalation conduits 214 and 218 through the first and second exhalation ports 212 and 216 to the chamber 124, thus avoiding the breathing of water and/or previously exhaled air during inhalation.

As disclosed in FIG. 4A, the first protrusion 306 formed on the flexible membrane 300 is sized and positioned such that the first protrusion 306 extends into the first exhalation conduit 214 when the flexible membrane 300 is in the fully-sealed position. Similarly, the second protrusion 308 formed on the flexible membrane 300 is sized and positioned such that the second protrusion 308 extends into the second exhalation conduit 218 when the flexible membrane 300 is in the fully-sealed position or in the partially-sealed position, as discussed below in connection with FIG. 2C. The function of the first and second protrusions 306 and 308 will be discussed in greater detail below.

b. Beginning Stage of Normal Exhalation

With reference now to FIG. 4B, the operation of the snorkel 100 during a beginning stage of normal exhalation is disclosed. As used herein, the term "normal exhalation" refers to exhalation at a rate of between about 100 ml/s and about 450 ml/s. As a user of the snorkel 100 exhales normally, air 150 passes from the lungs and mouth of the user back through the breathing port 126 into the chamber 124. Since the inhalation valve 102 through which air entered the inhalation conduit 122 is a one-way valve, air 150 that is exhaled by the user into the chamber 124 can not exit the snorkel 100 through the inhalation conduit 122. At the same time, the ambient water pressure 128 continues to press the flexible membrane 300 against the plate 202, thus maintaining the exhalation valve 112 in the fully-sealed position where the first and second exhalation ports 212 and 216 are sealed such that substantially no air nor water can flow from the chamber 124, through the chamber ports 204, and through the first and second exhalation ports 212 and 216. The exhaled air 150, therefore, builds up in the chamber 124 creating an exhalation pressure 130 in the chamber 124. The exhalation valve 112 remains disposed in the fully-sealed position as long as the exhalation pressure 128 within the chamber 124 combined with the biasing pressure 310 of the flexible membrane 300 (see FIG. 3B) is substantially less than the ambient water pressure 128.

c. Later Stage of Normal Exhalation

With reference now to FIG. 4C, the operation of the snorkel 100 during a later stage of normal exhalation is disclosed. As a user of the snorkel 100 continues to exhale normally, and as air 150 continues to pass from the lungs and mouth of the user back through the breathing port 126 into the chamber 124, the exhaled air 150 will continue to build up in the chamber 124, thus steadily increasing the exhalation pressure 130 in the chamber 124. As soon as the exhalation pressure 128 within the chamber 124 combined with the biasing pressure 310 of the flexible membrane 300 (see FIG. 3B) is substantially equal to the ambient water pressure 128, the exhalation valve 112 will transition into the "partially-sealed position" shown in FIG. 4C. When in the partially-sealed position, the flexible membrane 300 seals the second exhalation port 216 but does not seal the first exhalation port 212 such that air 150 can flow from the chamber 124, through the chamber ports 204, the first exhalation port 212, the first exhalation conduit 214, and exit the snorkel 100 through the exhalation tube 118 and the exhalation exit port 104 (see FIGS. 1A and 1B). The exhalation valve 112 remains disposed in the partially-sealed position as long as the exhalation pressure 128 within the chamber 124 combined with the biasing pressure 310 of the flexible membrane 300 (see FIG. 3B) remains substantially equal to the ambient water pressure 128.

The combination of the exhalation pressure 128 with the biasing pressure 310 may be necessary in situations where the ambient water pressure 128 is excessively high to counteract solely with the exhalation pressure 128. For example, where a user of the snorkel swims along the surface of a body of water, the flexible membrane 300 may be submerged at a depth of about 28 cm while the center of the user's lungs may only be submerged at a depth of about 13 cm. In this situation, the flexible membrane 300 may be configured to exert a biasing pressure 310 equivalent to or in the range of the depth difference between the centroid of the user's lungs and the flexible membrane 300. In this example, the biasing pressure 310 may be between about 10 cm water pressure and about 15 cm water pressure in order to account for the difference between the water pressure acting on the user's lungs and the water pressure acting on the flexible membrane 300. This would provide between about 0 cm water pressure and about 5 cm water pressure as positive end-expiratory pressure to the user, which may be physiologically comfortable for many users. A modest exhalation pressure increase relative to the depth of the centroid of the user's lungs may be accomplished by employing the example exhalation valve disclosed herein. It is understood that these depths are only estimates and may vary depending on the size and/or swimming technique of the user.

As disclosed in FIG. 4C, the first protrusion 306 is sized and positioned to act as a flow contour to better direct air flow into the first conduit 214. In detail, exhaled air 150 comes in contact with the first protrusion 306 as air 150 enters the first conduit 214. The first protrusion 306 is shaped to direct the air 150 to smoothly flow along the first protrusion 306 on its way up into the first conduit 214. The size, shape, and position of the first protrusion 306 can therefore contribute to smoother air flow and reduced turbulence.

In addition, FIG. 4C further discloses water-removal and noise reducing features of the first protrusion 306. Any water 170 that inadvertently enters the chamber 124 will naturally make its way down to the flexible membrane 300. Water 170 that remains on the flexible membrane 300 during normal exhalation may result in gurgling noises, which can be uncomfortable for a user of the snorkel 100. As the flexible membrane transitions from the fully-sealed position to the partially-sealed position, the size, shape, and position of the first protrusion 306 will facilitate the moving air 150 pulling the water 170 along the contour of the first protrusion 306 up into the first exhalation conduit 214. The position of the first protrusion 306 may also help alleviate puddling of the water 170 as the first protrusion 306 is positioned near to lowest point of the flexible membrane 300 and thus fills some the space where the water 170 would otherwise tend to puddle.

As disclosed elsewhere herein, the septum 210 may be off-center within the exhalation conduit 208 and may also be curved. The combination of being off-center and being curved results in the first exhalation conduit 214 having a slim crescent-shaped profile, which causes the velocity of the air 150 traveling through the first exhalation conduit 214 to be relatively high. Once the water 170 is pushed by the air 150 into the first exhalation conduit 214, the relatively high air velocity of the air 150 within the first exhalation conduit 214 results in the water 170 being pushed all the way to the top of the septum 210. Once the water 170 arrives at the top of the septum 210, a substantial portion of the water 170 can spill over the septum 210 into the second exhalation conduit 218, where the water will be trapped pending a forceful exhalation by the user, as discussed below in connection with FIG. 4D. The relatively larger volume of the second exhalation conduit 218 (with respect to the first exhalation conduit 214) can accommodate a relatively larger volume of the water 170 to be trapped, resulting in less spillage over to the first exhalation conduit 214 of the water 170, thereby keeping the first exhalation conduit 214 free of gurgle for quieter exhalations. Alternatively, the curving of the septum 210 and/or positioning the septum 210 off-center may instead enable the septum 210 to be shorter without decreasing the volume of the second exhalation conduit 218 relative to an alternative straight midline septum, thereby making it easier for water 170 to get drawn over the top of the septum 210 and into the second exhalation conduit 218. Once the water 170 is trapped in the second exhalation conduit 218, the water 170 no longer makes uncomfortable gurgling noises while breathing normally through the snorkel 100.

With reference now to FIGS. 4A and 4D, additional aspects of the operation of the snorkel 100 during normal exhalation are disclosed. While a user is exhaling at a gradual, normal pace, the exhalation valve 112 will maintain the exhalation pressure 130 in the chamber 124 as the exhalation valve 112 periodically allows exhaled air 150 to vent across the first exhalation port 212. In practice, the exhalation valve 112 may exhibit a fluttering quality in which the exhalation valve 112 is repeatedly opening and closing as the exhalation valve 112 regulates the exhalation pressure 130 in the chamber 124. As a result of this fluttering, noise and vibration may be heard and felt by the user as the exhalation valve 112 repeatedly transitions from the partially-sealed position shown in FIG. 4C to the fully-sealed position as shown in FIG. 4A.

In order to dampen this noise and vibration, the first protrusion 306 of the flexible membrane 300 is sized and positioned to bias against a sidewall of the first exhalation conduit 214 as the flexible membrane transitions to the fully-sealed position in order to dampen vibration in the flexible membrane 300. The first protrusion 306 is also sized and positioned such that a base of the first protrusion 306 is positioned closer to a base of the septum 210 than to a base of a sidewall of the first exhalation conduit 214. This positioning places the base of the first protrusion 306 a modest distance from the base of the sidewall of the first exhalation conduit 214 and may serve to position the contact point of the first protrusion 306 further up an inside surface of the exhalation conduit 208, which may result in effecting better seals between the plate 202 and the flexible membrane 300.

d. Forceful Exhalation

With reference now to FIG. 4D, the operation of the snorkel 100 during a forceful exhalation is disclosed. As used herein, the term "forceful exhalation" refers to exhalation at a rate greater than about 450 ml/s. When a user of the snorkel exhales forcefully, the exhalation pressure 130 in the chamber 124 will increase substantially. As the exhalation pressure 130 combined with the biasing pressure 310 of the flexible membrane 300 (see FIG. 3B) transitions quickly from being substantially equal to the ambient water pressure 128 to being substantially greater than the ambient water pressure 128, the exhalation valve 112 will transition to the "unsealed position" shown in FIG. 4D. When in the unsealed position, the flexible membrane 300 does not seal the first exhalation port 212 nor the second exhalation port 216 such that air 150 can flow from the chamber 124, through the chamber ports 204, through both the first and second exhalation ports 212 and 216, through both the first and second exhalation conduits 214 and 218, and exit the snorkel 100 through the exhalation tube 118 and the exhalation exit port 104 (see FIGS. 1A and 1B). The exhalation valve 112 remains disposed in the unsealed position as long as the exhalation pressure 128 within the chamber 124 combined with the biasing pressure 310 of the flexible membrane 300 (see FIG. 3B) remains substantially greater than the ambient water pressure 128.

In the unsealed position disclosed in FIG. 4D, the pressure of the forcefully exhaled air 150 will also cause any water resting on the flexible membrane 300 or positioned in either the first exhalation conduit 214 or trapped in the second exhalation conduit 218 to flow with the air 150 through either the first exhalation conduit 214 or the second exhalation conduit 218 out of the snorkel 100 through the exhalation tube 118 and the exhalation exit port 104 (see FIGS. 1A and 1B). This forceful exhalation thus causes a purge of all but relatively small amount of water 170 from the snorkel 100. For example, only about five ml to about ten ml of the water 170 may be retained in the snorkel 100 after a forceful exhalation. As even this small amount of retained water 170 may gurgle during subsequent exhalations, the second exhalation conduit 218 is sized, shaped, and configured to serve as a trap for this small amount of retained water 170. As disclosed in FIG. 4C, the septum 210 overlying this retained water 170 serves to keep the retained water 170 out of the flow of air 150 during normal exhalation in order to shield the retained water 170 from the flow of air 150 and any resulting gurgling.

With reference now to FIGS. 4A and 4D, additional aspects of the operation of the snorkel 100 during forceful exhalation are disclosed. While a user is exhaling forcefully, the exhalation valve 112 will maintain the exhalation pressure 130 in the chamber 124 as the exhalation valve 112 periodically allows exhaled air 150 to vent across the first exhalation port 212 and the second exhalation port 216 as the exhaled air travels up through the first and second exhalation conduits 214 and 218 on its way to the exhalation exit port 104 via the exhalation tube 118 (see FIG. 1B). As with normal exhalation, the exhalation valve 112 may exhibit a fluttering quality during forceful exhalation in which the exhalation valve 112 is regularly opening and closing as the exhalation valve 112 regulates the exhalation pressure 130 in the chamber 124. As a result of this fluttering, noise and vibration may be heard and felt by the user as the exhalation valve 112 transitions from the unsealed position shown in FIG. 4D to the fully-sealed position as shown in FIG. 4A.

In order to dampen this noise and vibration, the first protrusion 306 of the flexible membrane 300 is sized and positioned to bias against a sidewall of the first exhalation conduit 214 as the flexible membrane transitions to the fully-sealed position in order to dampen vibration in the flexible membrane 300. Similarly, the second protrusion 308 of the flexible membrane 300 is sized and positioned to bias against the septum 210 as the flexible membrane transitions to the fully-sealed position or transitions to the partially-sealed position in order to dampen vibration in the flexible membrane 300.

As disclosed in FIG. 4C, the second protrusion 308 may also be sized and positioned such that a base of the second protrusion 308 is positioned closer to a base of a sidewall of the second exhalation conduit 218 that to a base of the septum. This positioning of the second protrusion 308 a modest distance from the base of the sidewall of the second exhalation conduit 218 may serve to position the contact point of the second protrusion 308 further up the septum 210, which may result in effecting better seals between the plate 202 and the flexible membrane 300.

Although this invention has been described in terms of certain example embodiments, other example embodiments are possible. Accordingly, the scope of the invention is intended to be defined only by the claims which follow.

What is claimed is:

1. A valve for use in an underwater breathing device, the valve configured to produce positive end-expiratory pressure in the airway of a user of the underwater breathing device, the valve comprising:

a plate defining an exhalation port and at least one chamber port;

an exhalation conduit connected to the exhalation port, a lower portion of the exhalation conduit being divided by a septum which divides the exhalation conduit and the exhalation port into a first exhalation conduit connected to a first exhalation port and a second exhalation conduit connected to a second exhalation port; and a flexible membrane that is sealable against a surface of the plate and is sized and positioned to be capable of sealing the first exhalation port and the second exhalation port, the flexible membrane comprising:

a fully-sealed position in which the flexible membrane seals the first and second exhalation ports such that substantially no air nor water can flow through the first nor second exhalation ports;

a partially-sealed position in which the flexible membrane seals the second exhalation port but does not seal the first exhalation port such that air and water can flow from the at least one chamber port through the first exhalation port and substantially no water can flow from the second exhalation conduit through the second exhalation port; and an unsealed position in which the flexible membrane does not seal the first and second exhalation ports such that air and water can flow from the at least one chamber port through the first and second exhalation ports.

2. The valve as recited in claim 1, wherein a sidewall of the at least one chamber port is oriented substantially parallel to the orientation of a sidewall of the exhalation conduit.

3. The valve as recited in claim 1, wherein: the first exhalation port and the first exhalation conduit are substantially crescent-shaped; and the second exhalation port and the second exhalation conduit are substantially marquise-shaped.

4. The valve as recited in claim 1, wherein a volume defined by the first exhalation conduit is less than a volume defined by the second exhalation conduit.

5. The valve as recited in claim 1, wherein the surface of the plate comprises a rib that circumscribes the perimeters of the first exhalation port and the second exhalation port and extends below another surface of the plate.

6. The valve as recited in claim 5, wherein the largest open dimension of the at least one chamber port is smaller than the largest open dimension of the second exhalation port.

7. The valve as recited in claim 1, further comprising: a first protrusion formed on the flexible membrane, the first protrusion sized and positioned to bias against a sidewall of the first exhalation conduit as the flexible membrane transitions to the fully-sealed position in order to dampen vibration in the flexible membrane; and a second protrusion formed on the flexible membrane the second protrusion sized and positioned to bias against the septum as the flexible membrane transitions to the fully-sealed position or into the partially-sealed position in order to dampen vibration in the flexible membrane.

8. An underwater breathing device configured to produce positive end-expiratory pressure in the airway of a user of the underwater breathing device, the underwater breathing device comprising:

a chamber comprising a breathing port and an exhalation port, the chamber being configured such that when air is being exhaled through the breathing port into the chamber in a manner that restricts air from simultaneously escaping through the breathing port, there is no unrestricted passageway out of the chamber through which air can exit the underwater breathing device and, as a result, the exhaled air creates an exhalation pressure within the chamber; and a valve for restricting airflow from the chamber through the exhalation port, the valve comprising:

a plate defining the exhalation port;

an exhalation conduit connected to the exhalation port, a lower portion of the exhalation conduit being divided by a septum which divides the exhalation conduit and the exhalation port into a first exhalation port connected to a first exhalation conduit and a second exhalation port connected to a second exhalation conduit; and a flexible membrane that is sealable against a surface of the plate and is sized and positioned to be capable of sealing the first exhalation port and the second exhalation port, the flexible membrane being configured such that an opening force, comprising any exhalation pressure within the chamber, biases the flexible membrane in a first direction and a closing force biases the flexible membrane in a second direction, the first direction being substantially opposite the second direction, the flexible membrane comprising:

a fully-sealed position in which the flexible membrane seals the first and second exhalation ports such that substantially no air nor water can flow through the first nor second exhalation ports;

a partially-sealed position in which the flexible membrane seals the second exhalation port but does not seal the first exhalation port such that air and water can flow from the chamber through the first exhalation port and substantially no water can flow from the second exhalation conduit through the second exhalation port; and an unsealed position in which the flexible membrane does not seal the first and second exhalation ports such that air and water can flow from the chamber through the first and second exhalation ports.

9. The underwater breathing device as recited in claim 8, wherein the closing force comprises ambient water pressure when at least a portion of the underwater breathing device is submerged in water.

10. The underwater breathing device as recited in claim 8, wherein the opening force further comprises a biasing pressure of the flexible membrane.

11. The underwater breathing device as recited in claim 8, wherein: the first exhalation port and the first exhalation conduit are substantially crescent-shaped; and the second exhalation port and the second exhalation conduit are substantially marquise-shaped.

12. The underwater breathing device as recited in claim 8, wherein a volume defined by the first exhalation conduit is less than a volume defined by the second exhalation conduit.

13. The underwater breathing device as recited in claim 8, wherein the volume defined by the second exhalation conduit is at least twice the volume defined by the first exhalation conduit.

14. The underwater breathing device as recited in claim 8, wherein the flexible membrane further comprises a rib that circumscribes the perimeters of the first exhalation port and the second exhalation port and extends above a surface of the flexible membrane.

15. The underwater breathing device as recited in claim 8, further comprising: a first protrusion formed on the flexible membrane, the first protrusion sized and positioned to bias against a sidewall of the first exhalation conduit as the flexible membrane transitions to the fully-sealed position in order to dampen vibration in the flexible membrane; and a first protrusion formed on the flexible membrane, the second protrusion sized and positioned to bias against the septum as the flexible membrane transitions to the fully-sealed position or into the partially-sealed position in order to dampen vibration in the flexible membrane.

16. An underwater breathing device configured to produce positive end-expiratory pressure in the airway of a user of the underwater breathing device, the underwater breathing device comprising:

a chamber including a breathing port and an exhalation port, the chamber being configured such that when air is being exhaled through the breathing port into the chamber in a manner that restricts air from simultaneously escaping through the breathing port, there is no unrestricted passageway out of the chamber through which air can exit the underwater breathing device and, as a result, the exhaled air creates an exhalation pressure within the chamber; and a valve for restricting airflow from the chamber through the exhalation port, the valve being configured such that, when the chamber is submerged in water, any exhalation pressure within the chamber combined with a biasing pressure of the valve biases the valve in a first direction and ambient water pressure biases the valve in a second direction, the first direction being substantially opposite the second direction, the valve comprising:

a fully-sealed position in which substantially no air nor water can flow through the exhalation port, the valve being disposed in the fully-sealed position when any exhalation pressure within the chamber combined with a biasing pressure of the valve is substantially less than the ambient water pressure; and an unsealed position in which air and water can flow from the chamber through the exhalation port, the valve being disposed in the unsealed position when any exhalation pressure within the chamber combined with a biasing pressure of the valve is substantially greater than the ambient water pressure;

wherein the valve further comprises: an exhalation conduit connected to the exhalation port, a lower portion of the exhalation conduit being divided by a septum which divides the exhalation conduit and the exhalation port into a first exhalation port connected to a first exhalation conduit and a second exhalation port connected to a second conduit.

17. The underwater breathing device as recited in claim 16, wherein the valve further comprises: a partially-sealed position in which air and water can flow from the chamber through the first exhalation port but not through the second exhalation port, the valve being disposed in the partially-sealed position when any exhalation pressure within the chamber combined with a biasing pressure of the valve is substantially equal to the ambient water pressure.

18. The underwater breathing device as recited in claim 16, wherein: the first exhalation port and the first exhalation conduit are substantially crescent-shaped; and the second exhalation port and the second exhalation conduit are substantially marquise-shaped.

19. The underwater breathing device as recited in claim 16, wherein a volume defined by the second exhalation conduit is at least twice a volume defined by the first exhalation conduit.

* * * * *